United States Patent [19]

Hanley, Jr.

[11] 4,019,963

[45] Apr. 26, 1977

[54] COKE DISCHARGING SYSTEM

[75] Inventor: John F. Hanley, Jr., Roswell, Ga.

[73] Assignee: Envirotech Corporation, Menlo Park, Calif.

[22] Filed: Oct. 6, 1975

[21] Appl. No.: 619,850

[52] U.S. Cl. ..... 202/263

[51] Int. Cl.[2] ..... C10B 27/00

[58] Field of Search ..... 202/227, 262, 263

[56] References Cited

UNITED STATES PATENTS

| | | | |
|---|---|---|---|
| 3,715,282 | 2/1973 | Pries et al. | 202/227 X |
| 3,716,457 | 2/1973 | Schon | 202/227 X |
| 3,785,933 | 1/1974 | Edgar et al. | 202/263 |
| 3,788,236 | 1/1974 | Edgar et al. | 202/227 X |
| 3,839,161 | 10/1974 | Pries | 202/227 X |
| 3,843,461 | 10/1974 | Allen | 202/263 X |
| 3,846,252 | 11/1974 | Edgar et al. | 202/227 X |
| 3,869,352 | 3/1975 | Allen et al. | 202/227 |

*Primary Examiner*—Joseph Scovronek
*Assistant Examiner*—Arnold Turk
*Attorney, Agent, or Firm*—Robert E. Krebs; Thomas S. MacDonald

[57] ABSTRACT

In a coke quench car having a hood and a draft inducing mechanism or exhaust device, a closure plate apparatus is associated with the coke oven push guide and is positionable with respect to the open side of the quench car so as to substantially close the open side of the car. The gap between the guide and the edges of the open side of the quench car are draft openings through which air is drawn by the draft inducing mechanism to withdraw gaseous and particulate emissions from the coke as it is pushed into the car. The gap confines or concentrates the inflow of air so as to prevent discharge of gaseous or particulate emissions around the hood of the car.

7 Claims, 5 Drawing Figures

COKE DISCHARGING SYSTEM

BACKGROUND OF THE INVENTION

1. FIELD OF THE INVENTION

This invention relates to coke quenching apparatus and, more particularly, to an improved draft concentrating mechanism that reduces the escape of pollutants from the quench car.

2. DESCRIPTION OF THE PRIOR ART

Coke quench cars have been provided heretofore with a large, wide, open side facing the coke oven exit opening so as to permit the coke being pushed from the oven to fall freely into the cavity in the quench car. Such a quench car is shown and described in the J. E. Allen U.S. Pat. No. 3,843,461 and in the J. E. Allen, J. F. Hanley, Jr., F. K. Armour, F. G. Krikau and R. S. Patton U.S. Pat. No. 3,869,352. The quench cars of the two mentioned patents have draft inducing mechanisms thereon for pulling the gaseous and particulate emissions, sometimes called a "push cloud", or a "quench cloud", from the hood above the quenched coke. The emissions are passed through scrubbers where the gaseous and particulate materials are taken from the emissions prior to discharge as substantially clean air.

Although the quench cars of the mentioned patents are substantial improvements over the prior art devices and effectively reduce the escape of any appreciable amounts of gaseous or particulate matter, there were occasions when the nature of the push, the volume of emissions involved, and the like, permitted parts of the "push cloud" or "quench cloud" to escape around the hood of the quench car without passing through the scrubbers.

SUMMARY OF THE INVENTION

A pair of elongate closure plates are supported on opposite sides of the coke oven push guide and are of such a size that the open side of the coke quench car is substantially closed. The only opening into the quench car is through the push guide, through a narrow, continuous gap between the top and bottom edges of the closure plates and the overhanding hood and the exposed edge of the hopper of the quench car, and through the narrow gap or opening between the front wall of the closure plates and the vertical edges of the front and rear walls defining the opening in the side of the quench car. The draft induced by the draft inducing mechanism draws the "push cloud", "quench cloud" or emissions out of the quench car by drawing air into the quench car through the narrow gaps between the closure plates and the quench car. Due to the high volume of air of gases moved by the draft inducing mechanism, the restricted opening into the quench car created by the narrow gap around the edge of the open side of the quench car requires the air entering into the quench car to pass through the narrow gap with such intensity that no gaseous or particulate emissions can escape directly to the atmosphere from said quench car.

The closure plates extend beyond the push guide a sufficient distance on each side such that as the end of the open sided hopper of the quench car is aligned with the push quide, the closure plate will close the opening into the open sided hopper except for the narrow gap between said plate and the edge of the open side of the quench car. As the coke is pushed through the push guide into the quench car, the quench car may be slowly moved relative to the push guide so that the coke will be spread the length of the quench car. Quenching sprays in the quench car quench the coke emitting a cloud of gaseous and particulate matter which cloud is drawn from the car by the draft inducing exhaust device. The draft inducing exhaust device draws air into the car through the narrow gap between the closure plate and the edge of the open side of the quench car preventing escape of any emission from the open side of the car. As the car moves relative to the push guide, the closure plate on the one side of the push guide gradually passes beyond the opening into the car while the closure plate on the other side of the push guide gradually moves into covering position over said opening into the car. Therefore, the narrow gap between the closure plate and the quench car remains the same throughout the complete push of the coke from the appropriate oven so that air drawn in through the gap will prevent emissions from the open side of the quench car.

BRIEF DESCRIPTION OF THE DRAWINGS

The details of construction and operation of the invention are more fully described with reference to the accompanying drawings which form a part hereof and in which like reference numerals refer to like parts throughout.

In the drawing.

DESCRIPTION OF THE PREFERREED EMBODIMENT

Figures 1, 2:
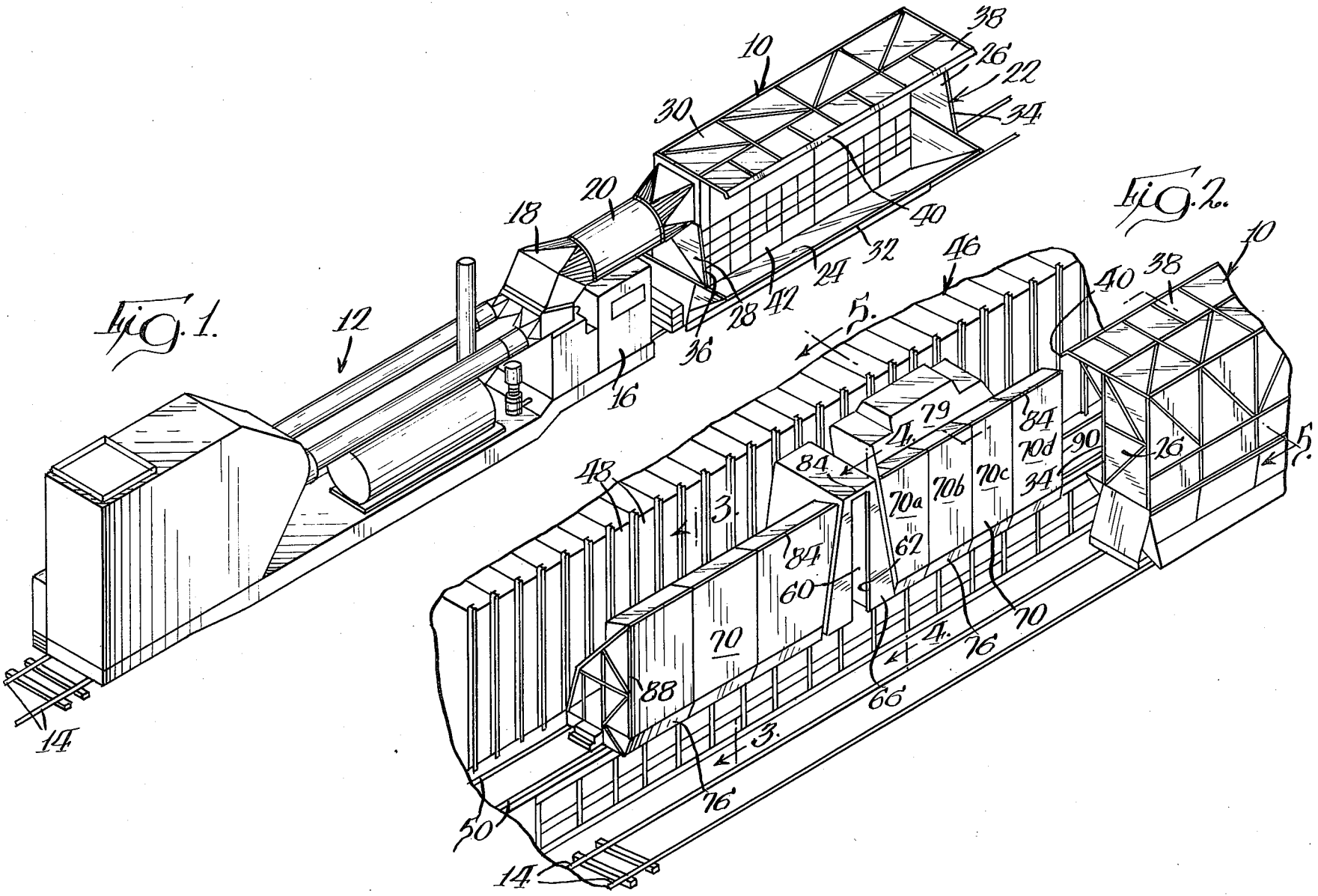
FIG. 1 is a perspective view of a coke quench car showing the open side of the coke-receiving cavity.
FIG. 2 is a perspective view of a battery of coke ovens with a coke push guide and improved closure plate.
Figure 5:
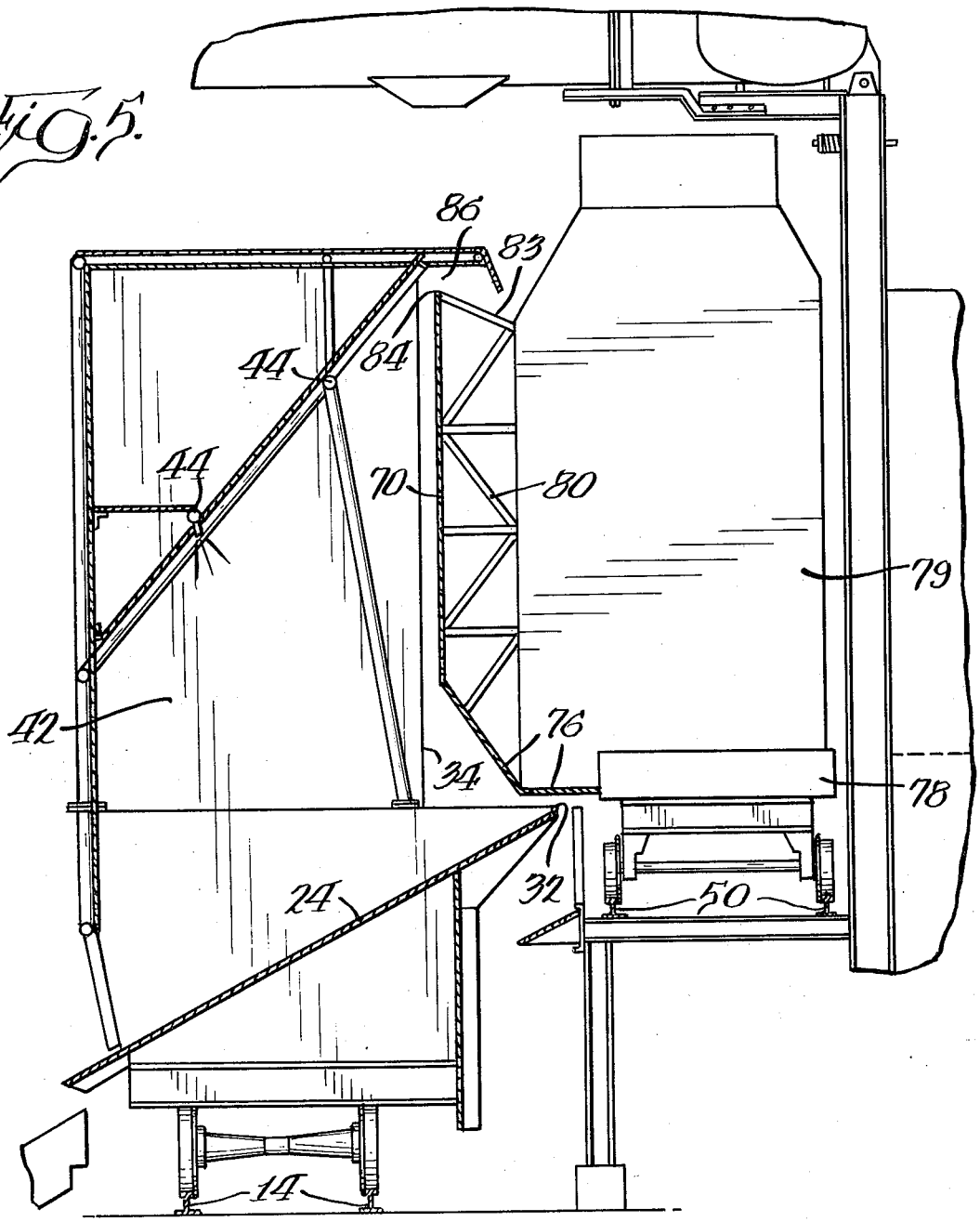

Referring to the drawings, and in particular to FIGS. 1, 2 and 5, a coke quench system is illustrated and comprises a quench car 10 secured to an equipment trailer 12 by means of a railroad coupler (not shown) and movable on rails 14. The car 10 is moved by a power unit (not shown) such as a donkey engine or the like. The equipment trailer 12 contains an operator's cab 16 which includes remote controls for operating the quenching in the quench car 10, the draft inducing and scrubbing device on the equipment trailer 12 and the donkey engine. The equipment trailer 12 mounts a combined draft inducing and scrubbing means 18, which is operative to draw gases emitted by the coke in the quench car 10 and to scrub the same. The draft inducing and scrubbing means 18 is connected to the hooded portion of the quench car by means of a flexible conduit 20 connected to the hood. The quench car 10 has an enlarged side opening 22 which is defined by a sloping bottom wall 24 by a forward wall 26 and a rearward wall 28 and by a roof 30. the bottom wall 24 has an outer edge 32, the forward wall 26 and rearward wall 28 have vertical edges 34, 36, and the roof 30 has a sidewardly projecting hood 38 which combine to form said side opening 22. The roof 30 has the sidewardly projecting hood 38 which extends beyond the edges 34,36 of the forward and rearward walls 26,28 and has an outer edge 40 which reaches to a point not quite vertically aligned with the outer edge 32 of the sloping bottom wall 24. The quench car 10 defines a cavity 42 into which the coke is gradually pushed and has a plurality of spray nozzles 44 mounted at strategic locations so as to provide a spray mist into the cavity 42 and onto the coke. The draft inducing device 18 on the trailer 12 is connected to the upper portion of the quench car in such a way as to draw gases out of the quench car. The gases drawn from the quench car are passed through the scrubber, and the like, so as to remove the gaseous and particulate emissions therefrom prior to the scrubbed gases being expelled from the scrubber to the atmosphere. The details of the quench car 10 and equipment trailer 12 and the operation of the quench sprays, draft inducing system, scrubber, and the like, are substantially as described and claimed in the J. E. Allen U.S. Pat. No. 3,843,461 and the J. E. Allen, J. F. Hanley, Jr., F. K. Armour, F. G. Krikau and R. S. Patton U.S. Pat. No. 3,869,352. For details of the operation and construction of the quench car and equipment trailer, reference is made to one or the other, or both, of those patents.

Figure 4:
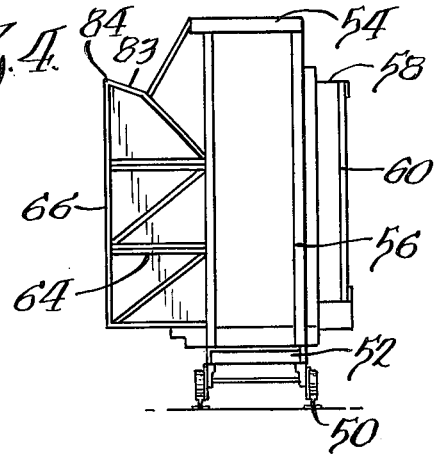
FIG. 4 is a cross-sectional view taken along the line 4—4 of FIG. 2; and, FIG. 5 is an elarged cross-sectional view taken along the line 5—5 of FIG. 2.

A battery of coke ovens 46 are charged, loaded and fired in a conventional fashion. Each oven in the battery has a door, such as, 48 which, when opened, presents an opening through which the coke in that oven is pushed when the coke-making function has been complete. A raised set of rails 50 is provided between the battery of coke ovens 46 and the rails 14 upon which the coke quench car 10 and equipment trailer 12 move relative to the battery of coke ovens. On the raised rails 50 is movably mounted an undercarriage 52 upon which is supported a coke oven push guide 54 which is adapted to be aligned with one of the doors 48 into one of the coke ovens 46. The coke push guide 54 is known in the art and has been used heretofore for aligning the opening in the coke oven with an appropriate quench car. Whith the push guide 54 in position in alignment withe the opening in the oven, the coke in the oven is pushed from the oven and through the push guide 54 whereupon the coke will fall into the quench car, or the like. As shown in cross section in FIG. 4, the push guide 54 contains a vertical framework 56 secured to the undercarriage 52 and has a rectangular passageway 58 extending transverse to the axis of the undercarriage 52. One end portion 60 of the passageway projects sidewardly toward the coke oven and has an opening 62 through the passageway which aligns with the opening in the coke oven. A supperstructure 64 is built on the opposite side of the vertical framework 56, which superstructure supports the opposite end of the passageway 58 and supports the front plate 66. The front plate 66 engages with the edge of the passageway 58 which defines the rectangular opening 62 with the long axis of the opening lying vertically to the undercarriage 52. The coke is pushed from one of the ovens 46 through the opening 62 in the push guide 54 and will fall from the guide 54 into the cavity 42 in the quench car 10.

Figure 3:
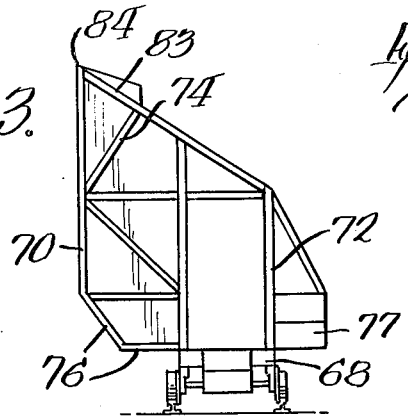
FIG. 3 is a cross-sectional view taken along the line 3—3 of FIG. 2.

Mounted on undercarriage 68 and extending in one direction on one side of the push guide 54 is a vertical framework 72 which, as can be seen in FIG. 3, has a superstructure 74 for supporting a flat sidewardly facing closure plate 70 thereon. The lower portion 76 of the closure plate 70 is tapered downwardly and inwardly and terminates at the framework 72. A counterbalance weight arrangement 77 is suspended on the opposite side of the undercarriage so as to hold the closure plate 70 in a vertical orientation. Mounted on undercarriage 78 on the opposite side of push guide 54 is a conventional door machine 79 which has a superstructure 80 supporting another closure plate 70 thereon. The closure plate 70 has the downwardly and inwardly directed lower portion 76 which terminates at the undercarriage 78. The closure plates 70 are of sufficient height and have the lower portions 76 extending back from the plane of the plates 70 in overlapping relationship with the outer edge 32 of the sloping bottom wall 24 of the quench car. The superstructures 64, 74 and 80 of the push guide 54 and closure plates 70, respectively, have upwardly angled frame members 83 such that the downwardly disposed outer edge 40 of the hood 38 overlaps behind the front plate 66 and the closure plates 70 with the top edges 84 of the front plate 66 and of the closure plates 70 disposed reasonably close to the inside of the hood 38 of the quench car 10 to provide a narrow gap 86 therebetween (FIG. 5).

The closure plates 70 project horizontally in opposite directions from the push guide 54 an amount such that the vertical remote edge 88 of the closure plate 70 will substantially align with the edge 34 of the forward wall 26 of the quench car 10 when the rearward wall 28 of the quench car aligns just beyond the rectangular opening 62 of the push guide 54. Since the closure plates 70 extend on opposite sides of the push guide 54, it can be seen that at no time will the enlarged side opening 22 of the quench car 10 be exposed to the atmoshpere by an amount in excess of the spacing between the edges of the opening in the quench car and the surfaces of the closure plates, all as will be described more in detail hereinafter.

The quench car 10 and equipment trailer 12 are brought up toward the closure plates 70 and coke push guide 54 on the rails 14 by means of the donkey engine. The quench car 10 will be moved until the vertical edge 34 of the side opening 22 of the car 10 is aligned just beyond the opening 62 in the push guide 54. That is, the edge 34 of the quench car 10 will align with the from plate 66 of push guide 54 just beyond the edge of the rectangular opening 62 in the push guide 54. The vertical edges 34, 36 of the opening in the quench car are spaced a short distance from the plane of the closure plates 70 and front plate 66 of the push guide so as to provide a restricted narrow gap therebetween. The top edge 84 of the closure plate 70 will be under the hood 38 of the quench car with the top edge 84 of the closure plate 70 spaced a short distance from the inside surface of the hood to form the narrow gap 86. The one remote edge 90 of the closure plate 70 will be substantially aligned with the vertical edge 36 of the opposite end of the side opening 22 in the quench car. The sloping wall 24 and the lower portion 76 of the closure plate 70 will overlap with and be relatively closely spaced to the outer edge 32 of the sloping bottom wall 24 of the cavity 42 of the quench car. In this way, the edges of the closure plates 70 and push guide 54 will be spaced a short distance from the quench car so as to provide a narrow gap or opening between the closure plate and the opening into the quench car.

With the exhaust device on the equipment trailer 12 operating, a strong suction will be created in the hood 38 of the quench car 10 which will draw a stream of air through the restricted narrow gaps between the closure plate and the edges of the opening 22 in the open side of the quench car. Burning coke pushed from the oven will be pushed through the opening 62 in the push guide 54 and will crumble and fall into the one end of the quench car, emitting great clouds of smoke and solid pollutants sometimes called a "push cloud". The quench sprays in the quench car will be activated to spray water and the like, onto the burning coke. The quench car is moved slowly past the push guide 54 so that as the coke is pushed continuously forward from the oven, it will fall into the cavity 42 in the quench car in a fairly even loading as the quench car passes the guide opening 62. The closure plate 70, on both sides of the push guide 54, will continually line up with the edges of the opening 22 into the quench car so as to provide a substantially continous, uniform narrow gap into the quench car around the edges of the closure plates 70. At the time the quench car has the rear edge 36 of the opening 22 aligned with the far edge of the push opening 62 in the push guide 54, the complete coke batch will have been pushed from the oven and the quench car will be substantially filled with the coke being quenched. The exhausting device will continously pull the air through the narrow gap around the edges of the closure plate and front plate of the guide and will pick up the gases and particlate emissions from the push cloud and quench cloud and move same through the scrubbers and demisters for cleaning same prior to discharging the cleaned gases to the atmosphere.

Due to the defining of a narrow gap by the closure plates 70, air drawn into the quench car will pick up the gases and particulate emissions and transport same to the scrubbers. Since the narrow gap between the closure plates 70 and the quench car is relatively small, there is virtually no possibility of any of the gaseous and particulate emissions escapting through the narrow gap to the atmoshpere. Accordingly, the provision of the closure plates restricts the opening into the quench car in such a way as to restrict the inflow of air so as to prevent the emission of a "push cloud" or a "quench cloud" to the atmosphere from beneath the hood. The horizontal extent of the closure plates is such that at no point in the process of pushing a batch of coke from an oven into the quench car will there be any excessive gap for air to freely flow into the quench car and permit gases to be emitted from said opening. Therefore, the location and size of the closure plates with respect to the opening in the quench car is such as to create the necessary high speed flow of air into the quench car opening so as to flush the emissions from the push cloud and quench cloud into the scrubbers without said emissions flowing forth into the atmosphere prior to scrubbing.

Upon completing the push of coke from one oven, the push guide 54 and closure plates 70 can be moved on the separate set of tracks so as to align the rectangular opening the push guide 54 with the appropriate opening in the other furnace or oven so that a new, fresh batch of coke may be pushed through the coke guide and into the quench car without polluting the atmoshpere.

The undercarriages 52, 68 and 78, upon which the push guide 54 and closure plates 70 are mounted, are individually supported on their own sets of trucks and wheels and coupling means being provided for coupling the one closure plate 70 to one side of the push guide 54 and for coupling the other closure plate 70 to the other side of the push guide 54. The closure plates 70 can be modularized in such a way that sections such as 70*a*, 70*b* and 70*c* may have an additional section 70*d* added or may have one section, i.e., 70*c*, removed so as to vary the longitudinal extent of the closure plate 70 so as to accommodate different lengths of quench cars.

I claim:

1. In a coke discharging system for reduced pollutant emissions around a coke quench car, the combination comprising: an enclosed, movable coke quench car having a roof, a bottom wall and forward and rearward walls defining one enlarged side opening providing access to a coke-receiving cavity, a hood connected to the roof and extending sidewardly in overhanging relationship with respect to vertical edges on said forward and rearward walls, means connected to said quench car for providing a draft through said opening and through said cavity, a coke push guide positioned between said quench car and a coke oven, said push guide having a planar forward surface with an opening adapted to be aligned with a portion of said side opening in said quench car, a pair of closure plates associated with said push guide and extending in opposite directions from said push guide, the forward faces of said closure plates define a forward surface substantially common with the forward surface of said push guide, each closure plate extends horizontally from said opening in the push guide a distance substantially equal to the length of the side opening in the quench car minus the width of the push guide and being horizontally spaced a short distance from said vertical edges of said side opening to form narrow gaps therebetween, said closure plates extending vertically from a location closely spaced from the bottom wall of the quench car to form a bottom gap, to a location closely spaced from the roof of the quench car to form a top gap therebetween, whereby the inflow of air created by said draft is concentrated through said gaps into said cavity to pick up and transport the emissions from coke being pushed into said cavity.

2. In a coke discharging system as claimed in claim 1 wherein each said closure plate has a planar surface facing the cavity and has a lower portion tapered away from said planar surface and defining a lower edge spaced from an outer edge of said bottom wall.

3. In a coke discharging system as claimed in claim 1 wherein each said closure plate and said push guide are mounted on rails for transport from one coke oven opening to another.

4. In a coke discharging as claimed in claim 1 wherein each closure plate and the push guide are mounted on separate undercariages having wheels engaging a pair of rails whereby each closure plate may be moved separately or may be moved together with the push guide.

5. In a coke discharging system for reduced pollutant emissions around a coke quench car, a combination comprising: an enclosed, movable coke quench car having a forward wall, a rearward wall, a roof and a bottom wall, said forward and rearward walls have vertical edges which combine with an outer edge of said bottom wall and with said roof to define one enlarged side opening providing access to a coke-receiving cavity within the enclosed car, means connected to said quench car for providing a draft through said opening and through said cavity, a coke push guide movable between said quench car and a battery of coke ovens and being positionable in alignment with a selected coke oven, said push guide having a forward surface with an opening adapted to be aligned with a portion of said side opening in said quench car, a pair of closure plates associated with said push guide and extending in opposite directions from said push guide, the forward faces of said closure plates lie substantially in a plane with each other and with the forward surface of said push guide, each closure plate extends outwardly from said opening a distance at least equal to the length of the side opening minus the width of the push guide, said closure plates are closely spaced with respect to said vertical edges of said forward and rearward walls, said closure plates extending vertically from a location closely spaced from said outer edge of said bottom wall to a location closely spaced with respect to said roof, whereby the draft means draws air through the space between the closure plates and said vertical edges, outer edge and roof for pulling airborne pollutants from the cavity of the quench car as the quench car is moved past the opening of said push guide.

6. In a coke discharging system as claimed in claim 5 wherein said coke push guide is mounted on an undercarriage and is movable on rails from alignment with one coke oven to another.

7. In a coke discharging system as claimed in claim 6 wherein each said closure plate is mounted on an undercarriage and is movable on the same rails as said coke push guide, said undercarriages of the closure plates being coupled to the opposite ends of said undercarriage of said push guide.

* * * * *